United States Patent [19]

Thykeson

[11] Patent Number: 4,852,730

[45] Date of Patent: Aug. 1, 1989

[54] LOCKING CONTAINER CARRIER

[75] Inventor: Everett Thykeson, San Ramon, Calif.

[73] Assignee: The Clorox Company, Oakland, Calif.

[21] Appl. No.: 225,400

[22] Filed: Jul. 28, 1988

[51] Int. Cl.[4] ..... B65D 75/00

[52] U.S. Cl. ..... 206/145; 206/427; 206/434; 294/87.2

[58] Field of Search ..... 206/145, 146, 147, 159, 206/161, 427, 431, 434; 229/40, 52 BC; 294/87.2, 87.28

[56] References Cited

U.S. PATENT DOCUMENTS

| | | | |
|---|---|---|---|
| 2,337,243 | 12/1943 | Huraff, Jr. | 206/145 |
| 2,823,064 | 2/1958 | Toensmeier . | |
| 3,016,259 | 1/1962 | Lawrence . | |
| 3,640,563 | 2/1972 | Wood | 206/145 |
| 3,784,246 | 1/1974 | Klygis . | |
| 3,834,750 | 9/1974 | Gauntlett . | |
| 3,926,307 | 12/1975 | Klygis | 294/87.2 |
| 3,985,228 | 10/1976 | Klygis . | |
| 4,180,191 | 12/1979 | Wood | 294/87.2 |
| 4,218,086 | 8/1980 | Klygis . | |
| 4,305,500 | 12/1981 | Jaeschke . | |
| 4,403,689 | 9/1983 | Wood . | |
| 4,509,639 | 4/1985 | Thompson | 206/159 |

*Primary Examiner*—David T. Fidei

*Attorney, Agent, or Firm*—Majestic, Parsons, Siebert & Hsue

[57] ABSTRACT

A carrier for containers such as bottles or the like made from a flat blank is provided. The blank is formed into a generally tubular carrier having like-shaped retainer sleeves which telescope within the ends thereof. Spaced parallel top and bottom walls have in-line apertures contained therein for receiving the tapered neck of a container. A locking means is provided so that when the retainer sleeves may be secured in the open ends of the carrier sleeve when in the container gripping mode. The locking means takes the form of articulatable tabs contained in the side walls of the carrier and retainer sleeves which register with each other so as to provide the locking function.

9 Claims, 3 Drawing Sheets

LOCKING CONTAINER CARRIER

BACKGROUND OF THE INVENTION

This invention relates to a carrier for containers such as bottles or the like of the type having a reduced neck portion above a shoulder portion.

Numerous container carriers are extant in the prior art. These container carriers generally are made from flattened cardboard or plastic material and are formed into a tubular structure. Two or more containers, such as bottles, are supported by the carrier. The carriers generally embrace the neck of the container. In this manner, the containers and labelling on the sides thereof are exposed to view. This is an improvement over the so-called wraparound container packaging that embraces the entire containers, such as is commonly found with six-packs of bottles.

The improved container carrier thus described is generally in the form of a hollow tubular sleeve having parallel spaced top and bottom walls. These walls may be interconnected by parallel spaced side walls. All of the walls are formed from panels of a flat blank of cardboard, plastic or the like. The blank is folded into a generally tubular form.

These prior art carriers are provided with aligned upper and lower apertures in the top and bottom walls. In this manner, the cap or rim of a bottle neck is supported by an upper aperture while a lower aperture receives the shoulder of the container. By suitable dimensioning, a stable structure is provided. One such prior art carrier is described in U.S. Pat. No. 2,823,064 issued to Toensmeier on Feb. 11, 1958. This is a carrier of the so-called sun- or star-burst type. The bottles are loaded by forcing the caps through the starburst openings on the top wall so that the tongues surrounding one opening spring back beneath the edge of the cap. In this manner, the bottles are held in position.

Another prior art carrier is disclosed in U.S. Pat. No. 3,016,529 issued to Lawrence on Jan. 9, 1962. With this carrier, the side walls are angled to interconnect a top wall with a broader bottom wall. The side walls slap back under the bottle cap qr rib on the bottle so that the weight of the bottles is supported by the side walls. With this structure, the tubular sleeve cannot be folded for transportation and storage due to the converging nature of the side walls. Accordingly, the sleeve cannot be folded for transportation or storage unless a further fold line is provided, which coincidentally would weaken the structure.

U.S. Pat. No. 4,218,086 issued to Klygis on Aug. 19, 1980 shows yet another carrier having converging side walls. Due to the inverted V-shape construction of the side of the carrier, the carrier can be deformed so as to hold the bottles in place when compressed in a vertical direction and to release the bottles when compressed in a horizontal direction. U.S. Pat. No. 4,305,500 issued to Jaeschke on Dec. 15, 1981 shows similar carrier having tear strips to facilitate removal of the bottles from the carrier.

Wood, U.S. Pat. No. 4,403,689 issued on Sept. 13, 1983 shows a bottle carrier which is not of the tubular form. Rather, bottles are secured at the neck portions as well as by depending side walls which are closely fitted to the sides of the bottles.

The basic disadvantage of these and other prior art carriers is that they do not provide for positive locking of the containers in the carrier. Thus, the containers can inadvertently be loosened from the carriers during handling and transport. Since the carrier typically serves for gripping, the container may fall out and be broken if it is not properly secured to the carrier. Since the material of the carrier is cardboard, plastic, and is easily deformed, such unwanted separation from the carrier can occur.

SUMMARY AND OBJECTS OF THE INVENTION

It is a principle object of the present invention to provide an improved carrier for containers such as bottles which positively grips the bottles for transport. Parenthetically, while the following discussion talks mainly in terms of bottles, other containers are contemplated and such is done merely for the sake of convenience and other containers are also contemplated. In fact, any container dimensioned to be suitable for the container sleeve is contemplated. The body is of generally tubular configuration, including a horizontal bottom wall and a spaced-apart parallel top wall. The top and bottom walls are interconnected by means of parallel spaced side walls.

The bottom wall is provided with relatively large apertures for receiving the tapering shoulder portions of containers such as bottles. The top wall includes smaller apertures aligned with the bottom wall apertures for receiving the container necks, which are narrower than the container shoulders. The containers are held by means of the contact between the bottom wall aperture and container shoulder and the contact between the top wall aperture bearing against either a rim or cap closure on the container end. In some cases, a trigger sprayer or the like having a cap skirt may substitute for the cap closure.

The tubular sleeve is made up from a flat blank of material such as cardboard or sheet plastic. The blank may be die cut so as to incorporate the various apertures. The blank is folded and glued along a longitudinal edge so as to form the tubular carrier structure.

Conveniently, a pair of containers may be secured in the carrier. The bottom wall apertures include a slit so that the container necks may be inserted into the bottom wall apertures from the side edge of the container by a slight deformation of the bottom wall. The apertures in the top wall, on the other hand, are arcuate and open at the outer edge of the sleeve. This also facilitates insertion of the container necks from the side. In this manner, two containers may be located side-by-side and held in position by means of the carrier sleeve.

In order to aid in strength and rigidity as well as to provide positive locking of the containers within the carrier sleeve, a pair of hollow retaining sleeves are provided. Each retaining sleeve is fabricated in a manner similar to that of the carrier sleeve. That is, it is made up from a flat blank by folding on score lines. Each retaining sleeve has top and bottom walls and connected side walls. Die cut arcuate apertures are formed in the top and bottom walls and are positioned so as to interlink with the top and bottom wall apertures of the carrier sleeve. The arcuate shapes may be V- or U-shaped or any other shape dimensioned so as to accommodate a particular size of container. Because of the flexibility of dimensioning made possible by this design, containers of differing shape and size may be juxtaposed and secured within the container carrier. The apertures may be dimensioned to encompass a cylindrically shaped bottle or have an oval shape to accommodate the type of bottle shape commonly found with trigger spray dispensers. A desirable packaging combination is a dispenser container with a trigger sprayer together with a refill bottle having a cap closure.

After positioning the container neck within the carrier sleeve, the retainer sleeve is telescoped within the carrier sleeve and the container neck is thereby gripped at all points therearound. The container shoulder is also gripped in the same manner. The retainer sleeve enhances stability because it adds a double wall thickness. In addition, the V-shaped apertures are able to grip the container at all points therearound.

A locking means is also provided for holding the retainer sleeves in position within the container sleeve. In this manner, the containers are positively held in the carrier sleeve for storage and transport.

The locking means takes the form of locking tabs die cut into the side wall of the carrier. A pair of opposed locking tabs are die cut into the side wall of the carrier and are articulatable into accommodating apertures formed by similar die cut side tabs in the side walls of the retainer sleeves. To function, only an aperture need be included in the side wall of the retainer sleeves for receiving the articulatable tabs on the container sleeve. The tabs are dimensioned so that the tabs on the container sleeve may be manipulated into an engaging relationship with the aperture formed by the tabs on the retainer sleeve when the containers are fully engaged in the carrier sleeve. A simple reverse manipulation will unlock the tabs and thereby permit removal of the retainer sleeves because nothing is destroyed as with tear tabs. The carrier may be re-used any number of times. Both the carrier and retainers are foldable into a flat position for storage and transport.

DETAILED DESCRIPTION OF THE PREFERRED EMBODIMENT

Figure 1:
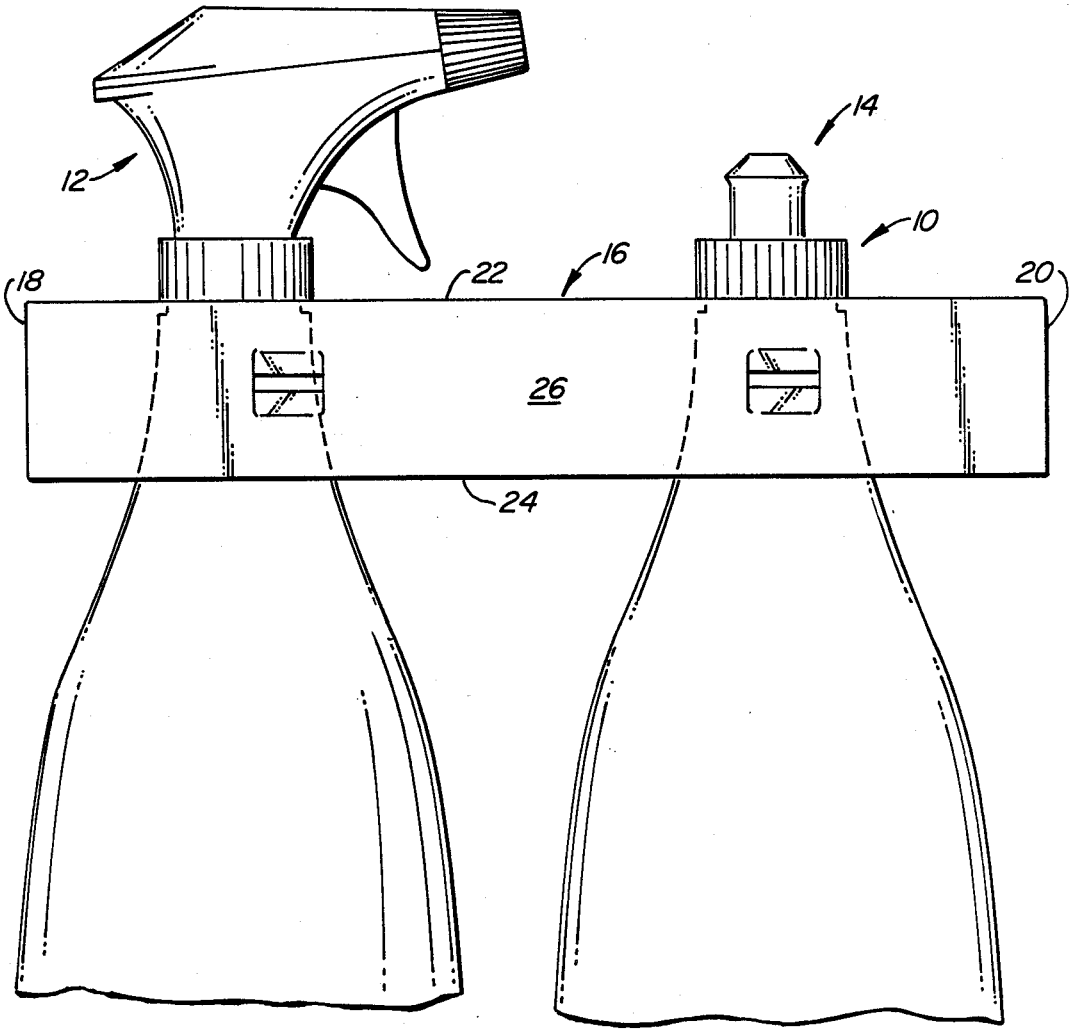
FIG. 1 is a side elevational view of the subject invention with bottle containers having tapered neck and shoulder portions engaged therein.

Referring now to FIG. 1, the car is shown generally at 10. The carrier contains and supports, by way of example, a dispensing container or bottle of the trigger sprayer container type 12. It also contains and supports a similarly shaped container bottle 14. As may be seen in FIGS. 1 and 2, carrier assembly 10 is comprised of a generally tubular, elongated hollow carrier sleeve 16 having open ends 18, 20. Still referring to these two figures, the carrier sleeve has top and bottom walls 22, 24 which are joined by left and right side walls 26, 28, respectively.

Figure 3:
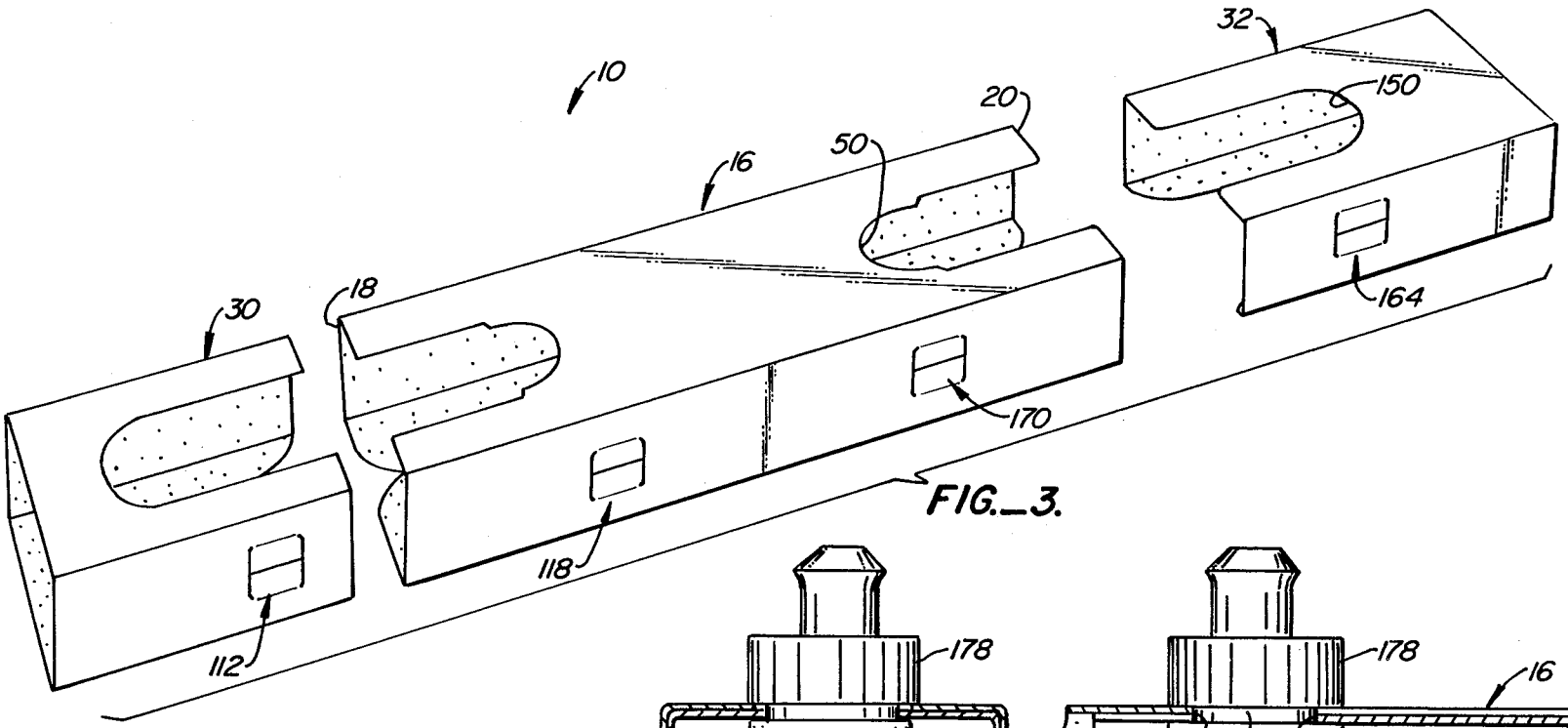
FIG. 3 is an exploded view of the invention showing details of the tubular carrier body and retainer sleeves.

Turning to FIG. 3, it may be seen that the carrier assembly includes a pair of opposite retainer sleeves 30, 32 which are telescopable within open ends 18, 20, respectively, of carrier sleeve 16.

Figure 6:
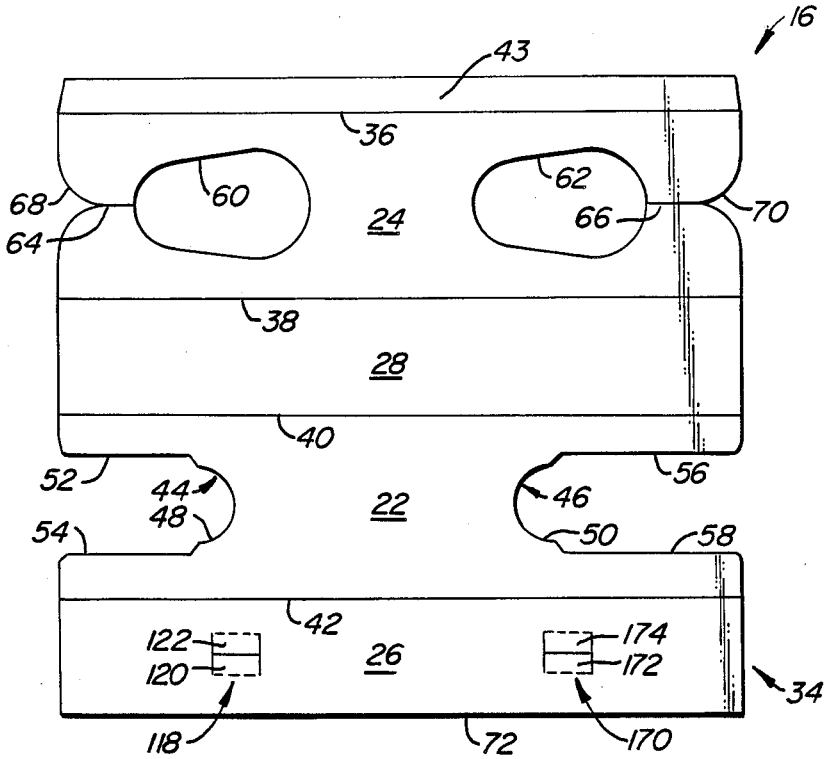
FIG. 6 is a plan view of a blank from which the carrier of this invention is formed.
Figure 7:
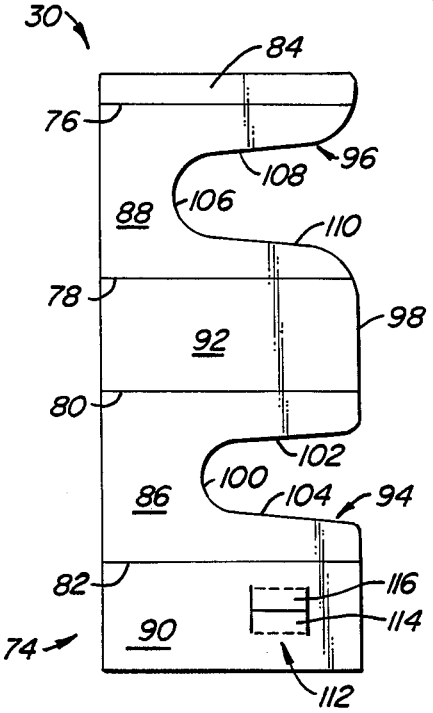
FIG. 7 is a plan view of a blank from which the left retainer sleeve of this invention may be formed.
Figure 8:
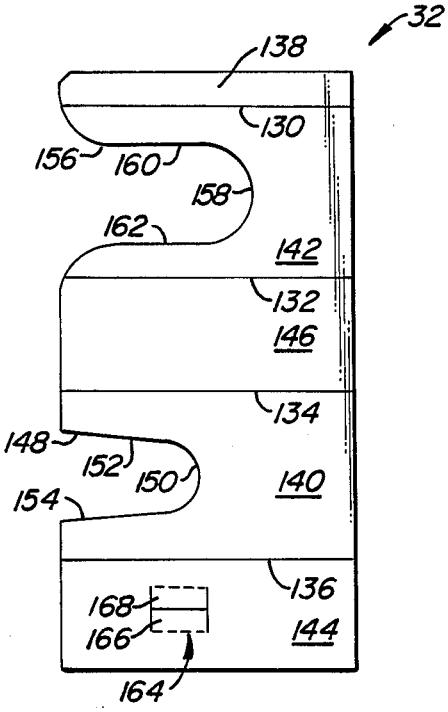
FIG. 8 is a plan view of a blank from which the right retainer sleeve of this invention may be formed.

Turning now to FIGS. 6 through 8, the details of construction of the various sleeves may be seen. With particular reference to FIG. 6, carrier 16 may be formed from a flat blank which is die cut to the shape shown. Specifically, blank 34 is shown to be of a generally rectangular shape having horizontally directed fold lines 36, 38, 40, 42 to aid in construction. The fold lines divide the blank into a glue panel 43 of narrow dimension as well as other panels that ultimately from the top, bottom, left and right side walls numbered 22, 24, 26, and 28, respectively.

Also die cut into blank 34 are top and bottom wall apertures that will be in alignment when the blank is formed up into the tubular shape of the carrier. These apertures are a pair of open-ended generally U-shaped apertures 44, 46. These apertures have a half-circular arcuate intercut 48, 50 and respective parallel side edges 52, 54 and 56, 58.

Referring to the bottom wall 24, a pair of generally oval-shaped bottom wall apertures 60, 62 are die cut therein. The particular shape of these apertures is such as to conform with the shoulder portion of the container that will be secured in and carried by the container. Slits 64, 66 are die cut at the outermost edge of the oval aperture 60, 62. Generally V-shaped entry portions 68, 72 are also die cut to transcend to the slits 64, 66. In this manner, containers may be inserted from the side of the built-up carrier blank.

In creating the carrier 16 from blank 34, the panels are first folded about the fold line to form a tubular structure. Glue seal 43 ultimately contacts the inner surface of wall 26 along free edge 72. The glue panel may be secured by means of stapling, gluing or the like.

In a similar manner, left retainer sleeve 30 is made up from a blank 74 of generally rectangular configuration as best seen in FIG. 7. This blank also includes parallel fold lines 76, 78, 80 and 82. These form in turn glue panel 84, bottom wall 86, top wall 88, left side wall 90, and right side wall 92.

Generally V-shaped die cuts 94, 96 are located in top and bottom walls 86, 88, respectively These open to outer edge 98 of blank 74. V-shaped aperture 94 is comprised of a circular arcuate inner cut 100 and side edges 102, 104. In like manner V-shaped aperture 96 is comprised of an arcuate inner cut 106 and side edges 108, 110.

Also die cut into left side wall 90 is a locking means 112 comprised of die cuts which form a pair of tabs 114, 116 which are articulatable about dotted hinge lines shown. Returning to FIG. 6, a like locking means 118 having tabs 120, 122 is formed by die cuts. As with the carrier 16, the retainer sleeve 30 is formed by bending along the fold lines and securing along glue strip 84.

Turning to FIG. 8, the right retainer sleeve 32 is constructed in a similar fashion to left retainer sleeve 30. It includes fold lines 130, 132, 134 and 136 forming glue panel 138 and top wall 140, bottom wall 142, left side wall 144, and right side wall 146. Located in top wall 140 is an aperture 148 comprised of an inner arcuate cut 150 and side edges 152, 154.

Bottom wall 142 is shown having a U-shaped aperture 156. This aperture is made up from arcuate semicircular inner cut 158 and side edges 160, 162. Included in left side wall 144 is a locking means 164 in the form of a pair of tabs 166, 168 formed by die cutting. These correspond with a similar locking means 170 formed by die cutting into tabs 172, 174 in side wall as seen in FIG. 6.

Figure 2:
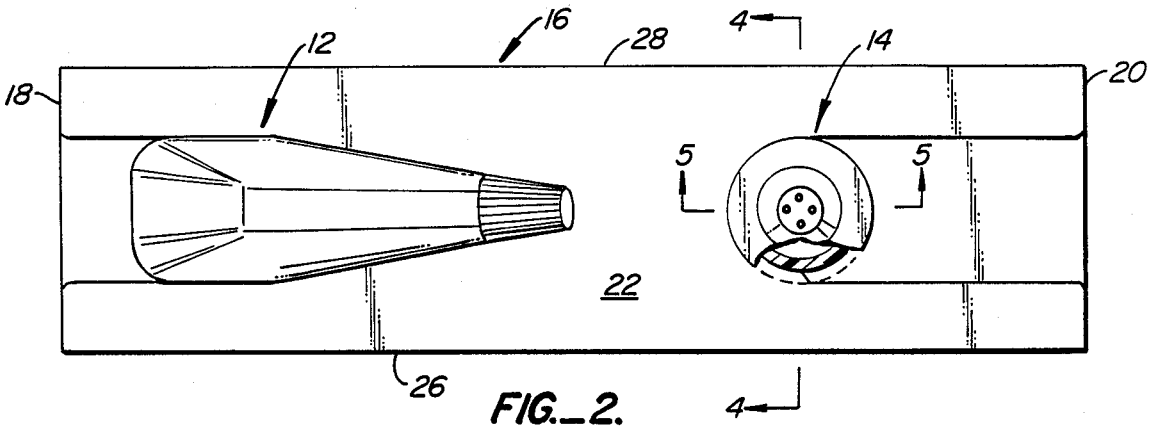
FIG. 2 is a top plan view of the same.

In use, the containers to be secured for carrying are inserted into open ends 18, 20 of carrier 16 as seen in FIG. 2. As may be recalled, the containers enter apertures 60, 62 by means of slits 64, 66 and a deformation of bottom wall 24 as best seen in FIG. 6.

Figure 4:
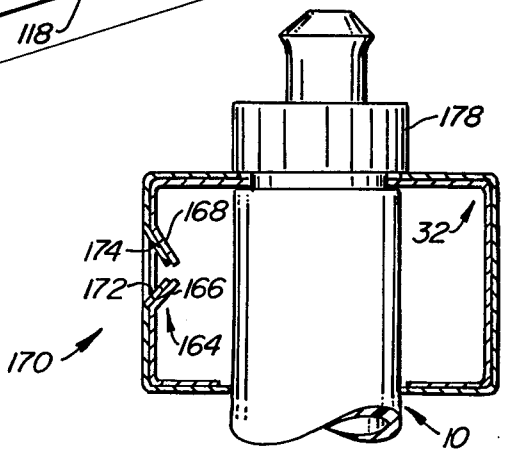
FIG. 4 is a cross-sectional view taken along the lines 4—4 in FIG. 2.
Figure 5:
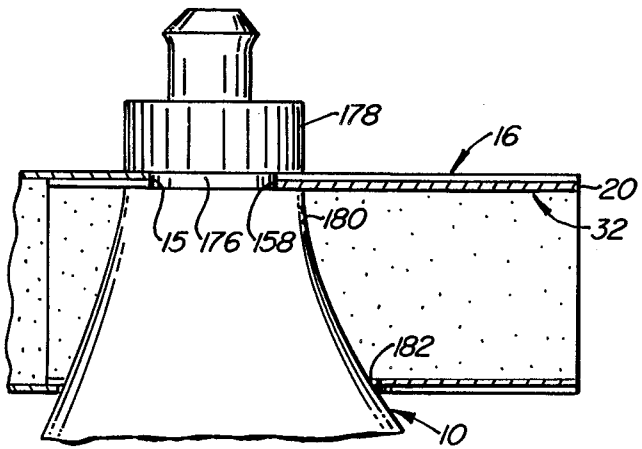
FIG. 5 is a cross-sectional view taken in the direction 5—5 in FIG. 2.

As shown in FIGS. 4 and 5, retailer sleeve 32 is inserted within open end 20 of carrier 16 and is telescoped therein. As aforementioned, this provides a double wall and therefore enhanced strength to the carrier. Retainer 32 is dimensioned so as to be in close contacting relation with the interior of carrier 16. As may be seen in these Figures and in Figure 3, arcuate inner cut 150 is closely fitted around substantially one-half of neck 176 of bottle 10. Inner cut 50 is similarly closely positioned around the other half bf neck 176. Because cap closure, which is generally cylindrical and enlarged bottle neck portion 180 are of a greater diameter than the diameter of arcuate portions 50 and 150, the container 10 will be retained. It should be also noted that retainer 32 is in close contacting relationship with bottle 10 at 182. Turning to FIG. 6, it may also be realized that aperture 62 of an oval shape is dimensioned so as to be in close contacting relationship with bottle 10 around its entire neck. In this manner, bottle 10 is held in a stable relationship with respect to the carrier.

With specific reference to FIG. 4, a locking means 170 is shown in the locked position cooperating with a locking mechanism 164 of inner retainer 32 As shown, tabs 172, 174 are manipulated inwardly along with tabs 164, 168. In the position shown, the retainer sleeve will be prevented from moving and thereby the bottle will be locked in position. In order to unlock sleeve, the tabs may be simply manipulated so that they are flush with side walls 26 and 144 and the retainer sleeve removed. This will then allow bottle 10 to be removed.

It should be realized that various combinations of tabs and apertures may be provided with equivalent results. For example, rather than having opposing tabs, a single tab which is articulatable in an inward direction would also suffice. It may also be seen that just a tab or tabs in the carrier may be articulated into a snugly-fitting aperture in a retainer sleeve, also with equivalent results. Further, a tab or tabs could be die cut into the retainer, which tab or tabs would articulate with a retainer in the carrier, with equivalent results.

While the cap has been illustrated in this preferred embodiment, two equivalent structures are also contemplated. For example, a rib molded into the container neck would also suffice to provide a stop against removal of the bottle.

It is to be understood that while the invention has been described above in conjunction with the preferred specific embodiment thereof, that the description is intended to illustrate and not limit the scope of the invention, which is defined by the scope of the appended claims.

I claim:

1. A carrier for containers having an elongated neck finish above a shoulder, said neck finish having a first width, and an enlarged closure means at the end of said neck finish, said carrier comprising:

(a) an elongated body having top and bottom portions;

(b) a first aperture on the said top portion of said body for closely receiving a portion of said neck, said top portion of said body adapted to bear against said enlarged closure means;

(c) a first aperture on the bottom portion of said body juxtaposed with said aperture on said top portion of said body for closely receiving said shoulder; and (d) a first retainer means closely receiving the remaining portion of said neck adapted to bear against said enlarged closure means in contacting relation with said body, adapted to hold said container therein, said retainer means being separable from said body so as to permit removal of the container from said body.

2. The invention of claim 1 wherein said body comprises an elongated hollow sleeve, and wherein said first retainer means comprises a first hollow retainer sleeve dimensioned to telescope within said body.

3. The invention of claim 2 further including , locking means for releasably locking said first retainer sleeve to said body.

4. The invention of claim 3 therein said locking means comprises at least one hinged tab on said body which is positionable into a closely fitting aperture in said first retainer sleeve.

5. The invention of claim 4 wherein the number of tabs is two, each tab being positioned to be oriented in a direction opposite the other so as to swing away from the other when rotated about its hinge into position in said aperture in said first retainer sleeve.

6. The invention of claim 2 further including a second aperture on said top portion of said body, a second aperture on said bottom portion of said body, said second apertures being aligned with each other and spaced from said first apertures, said second apertures also serving for receiving a container.

7. The invention of claim 6 further including a second retainer means for retaining a container in said second apertures, said second retainer means comprising a second hollow retainer sleeve dimensioned to telescope within said body, said body defining a pair of opposite open ends, said first retainer sleeve telescoping within one of said open ends and said second retainer sleeve telescoping within the other of said open ends so that a pair of containers are adapted to be retained in said body in side-by-side spaced relation.

8. The invention of claim 7 further including locking means for releasably locking said first and second retainer sleeves in said body.

9. The invention of claim 8 therein said locking means comprises hinged tabs on said body juxtaposed with apertures in said retainer sleeves.

* * * * *

UNITED STATES PATENT AND TRADEMARK OFFICE

CERTIFICATE OF CORRECTION

PATENT NO. : 4,852,730

DATED : August 1, 1989

INVENTOR(S) : Everett Thykeson

It is certified that error appears in the above-identified patent and that said Letters Patent is hereby corrected as shown below:

Column 6, Line 26, in Claim 3: delete ... "," locking

Column 6, Line 29, in Claim 4: replace "therein" with --wherein--

Column 6, Line 57, in Claim 9: replace "therein" with --wherein--

Signed and Sealed this

Twelfth Day of June, 1990

*Attest:*

HARRY F. MANBECK, JR.

*Attesting Officer*

*Commissioner of Patents and Trademarks*